US008100045B2

(12) United States Patent
Osborn et al.

(10) Patent No.: US 8,100,045 B2
(45) Date of Patent: Jan. 24, 2012

(54) HYDRAULIC CYLINDER ROD POSITION SENSOR

(75) Inventors: Jason Osborn, Oakes, ND (US); Daniel Krieger, Bismarck, ND (US); Darron Carr, Morris, MN (US)

(73) Assignee: Clark Equipment Company, West Fargo, ND (US)

( * ) Notice: Subject to any disclaimer, the term of this patent is extended or adjusted under 35 U.S.C. 154(b) by 556 days.

(21) Appl. No.: 12/255,083

(22) Filed: Oct. 21, 2008

(65) Prior Publication Data

US 2010/0095840 A1 Apr. 22, 2010

(51) Int. Cl.
*F15B 15/14* (2006.01)
*F15B 15/28* (2006.01)

(52) U.S. Cl. ..... 91/1; 92/5 R

(58) Field of Classification Search ..... 91/1; 92/5 R
See application file for complete search history.

(56) References Cited

U.S. PATENT DOCUMENTS

| | | | | |
|---|---|---|---|---|
| 4,386,552 | A * | 6/1983 | Foxwell | 92/5 R |
| 4,879,440 | A * | 11/1989 | Lymburner | 92/5 R |
| 5,138,934 | A * | 8/1992 | Murayama et al. | 92/5 R |
| 5,471,147 | A | 11/1995 | Allen et al. | 324/635 |
| 5,941,921 | A | 8/1999 | Dasys et al. | 701/50 |
| 6,450,048 | B1 | 9/2002 | Samuelson et al. | 73/866.5 |
| 6,694,861 | B2 | 2/2004 | Glasson | 92/5 |
| 7,059,238 | B2 | 6/2006 | Albright et al. | 92/5 |
| 7,120,523 | B2 | 10/2006 | Muller | 701/30 |
| 7,207,127 | B2 | 4/2007 | Rohr | 37/308 |
| 2001/0018861 | A1 | 9/2001 | Glasson | 92/5 |
| 2005/0081710 | A1 | 4/2005 | Albright et al. | 92/5 |

FOREIGN PATENT DOCUMENTS

| | | |
|---|---|---|
| DE | 3405673 | 4/1985 |
| DE | 199 53 054 A1 | 5/2001 |
| DE | 19953054 A1 * | 5/2001 |
| DE | 20 2006 012 815 | 1/2008 |
| DE | 202006012815 U1 * | 1/2008 |
| EP | 074266 | 3/1983 |
| WO | WO2008019838 | 2/2008 |

OTHER PUBLICATIONS

International Search Report PCT/US2009/061134, filed Oct. 19, 2009.
Written Opinion PCT/US2009/061134, filed Oct. 19, 2009.
Explanation Via Written Opinion of DE 199 53 054.
Penny + Giles Brochure—Publication Prior to Oct. 1, 2007. 4 pgs.

* cited by examiner

*Primary Examiner* — Thomas E Lazo
(74) *Attorney, Agent, or Firm* — John D. Veldhuis-Kroeze; Westman, Champlin & Kelly, P.A.

(57) ABSTRACT

A fluid pressure cylinder assembly has a sensor to provide a signal indicating the amount of extension of a piston rod from the cylinder. The sensor includes a sleeve that is fixed relative to a base of the cylinder and passes into a longitudinal bore in the piston rod, and the piston rod carries a sensor core that is in the bore and is secured to the piston rod at an end opposite from a piston on the rod. The core slides on the interior of the sensor sleeve. A connection is provided to the sensor sleeve such that as the core moves relative to the sensor sleeve a signal indicating the amount of movement and the relative position of the cylinder base and the piston rod is provided.

13 Claims, 5 Drawing Sheets

HYDRAULIC CYLINDER ROD POSITION SENSOR

BACKGROUND OF THE DISCLOSURE

The present disclosure relates a sensor for sensing the position of a piston rod of a hydraulic cylinder assembly relative to a reference position, and providing signals indicating the position. The sensor is used for hydraulic cylinders on a prime mover, such as the cylinders used for lift arms on a loader, and the signals are compatible with an overall machine operation network.

Sensors for determining the extension of piston rods have been used. The prior art sensors will provide signals indicating the extension of a piston rod from a reference position. The prior art sensor mountings are arranged differently and require difficult manufacturing processes.

SUMMARY OF THE DISCLOSURE

The present disclosure relates to a hydraulic cylinder that has an internal piston and an extendable and retractable piston rod connected to the piston. The cylinder is used, in the form disclosed, for operating a component on a compact tool carrier, such as a compact skid steer or wheeled loader. The cylinder has a very accurate, and easily installed sensor for determining the position of the piston rod relative to a retracted or other base reference position. The sensor includes a tubular first sensor sleeve component that is attached to a circuit board housing that is recessed in a bore in the base of the cylinder. A sensor core rod is attached to an outer end of the piston rod, adjacent the piston rod end connector. The piston rod has a bore that slidably receives the sensor sleeve component and the sensor core rod. The sensor core rod extends into the sensor sleeve and forms a core for an inductive type sensor.

The connections for connecting the sensing components to external circuitry are mounted in the circuit board housing that is retained entirely in a bore in the cylinder base. The mounting of the circuit board housing is a bore in the cylinder base keeps the circuit and connections from extending into the cylinder, and does not require the base to have extra length for the circuitry. The circuit board housing supports a circuit board, including electrical connections for the tubular sensor sleeve, that is inside the bore in the piston rod. The sensor core rod fits inside the sensor sleeve and is anchored to a sensor rod head that is pressed into a bore portion at the remote end of the piston rod, that is, near the exterior rod end.

A cross bore extends from an exterior of the cylinder base to intersect the bore for the circuit board housing. The circuit board housing has a connector opening that has distinct corners, as shown a square that is skewed relative to the longitudinal axis of the cylinder, so it is a diamond-shape when viewed through the cross bore in the base. A circuit board connector fits into the cross bore and has an end with a shape that fits into the corners of the opening in the circuit board housing. The circuit board connector is made such that it can be placed into the connector opening of the circuit board housing in a plurality of rotational positions about the axis of the cross bore. As shown, with a skewed square opening the connector can be placed at any one of four positions oriented at 90 degree intervals, and the circuits on the circuit board will be connected correctly, so that assembly of the sensor components is simplified.

The present piston rod position sensor has parts that are positioned in the hydraulic cylinder accurately and quickly. The ability to press fit the sensor core rod into a bore in the piston rod, as well as the ability to connect the external circuit board connector in any one of four different rotational positions with proper contact for energizing the sensor assembly, makes assembly easier. Orienting the outer end of the external circuit board connector in one of the four possible positions places the connector end facing properly to suit the installation location of the cylinder, and reduces manufacturing time.

The mounting of the sensor core rod, and the tubular sensor sleeve, in an interior bore in a standard length hydraulic cylinder rod and with the circuit connection in the hydraulic cylinder base permits the present cylinder assembly with the rod position sensor, to have the same retracted or reference length between the cylinder and piston rod mounting pins (pin to pin dimensions), and also have the same amount or length of piston rod extension, as a cylinder conventionally used, but without the position sensor.

DETAILED DESCRIPTION OF ILLUSTRATIVE EMBODIMENTS

Figure 1:
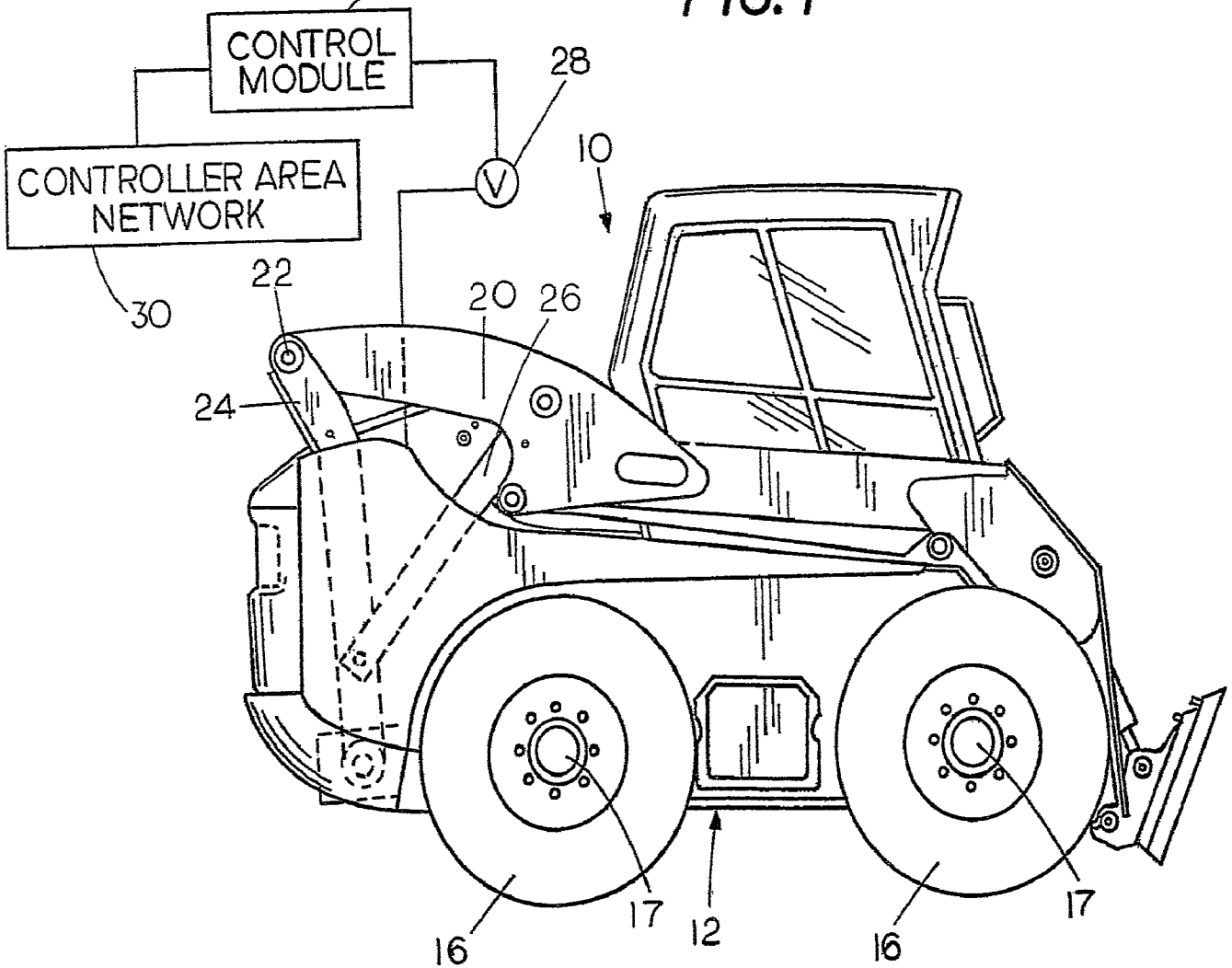
FIG. 1 is a side view of a typical compact tool carrier comprising a compact loader utilizing hydraulic cylinders including the improvement of the present disclosure with lift cylinders for the lift arms.

A typical compact tool carrier or work machine comprises a loader assembly 10 that is shown as a skid steer loader, and has a loader frame 12, and axles 17 that mount drive wheels 16. The work machine or loader 10 has lift arms 20 that are pivotally mounted as at 22 to a pair of upright arms 24. The lift arms are raised and lowered relative to the loader by operating a hydraulic actuator or cylinder assembly 26 for operating a suitable valve 28, controlled from a controller area network (CAN) 30 operating through a control module 32.

The network 30 is a network that controls various functions of the compact loader 10, and certain controls will be limited or not operable if the lift arms 20 of the compact loader are raised above a certain height, for example. The signals indicating the extension (position) of the piston rods of cylinders assemblies 26, or other cylinders, provide information that is processed for controlling machine functions. A sensor provides signals indicating the position of the cylinder rod of various cylinders used on the loader 10 to the network 30 and control module 32.

Figure 2:
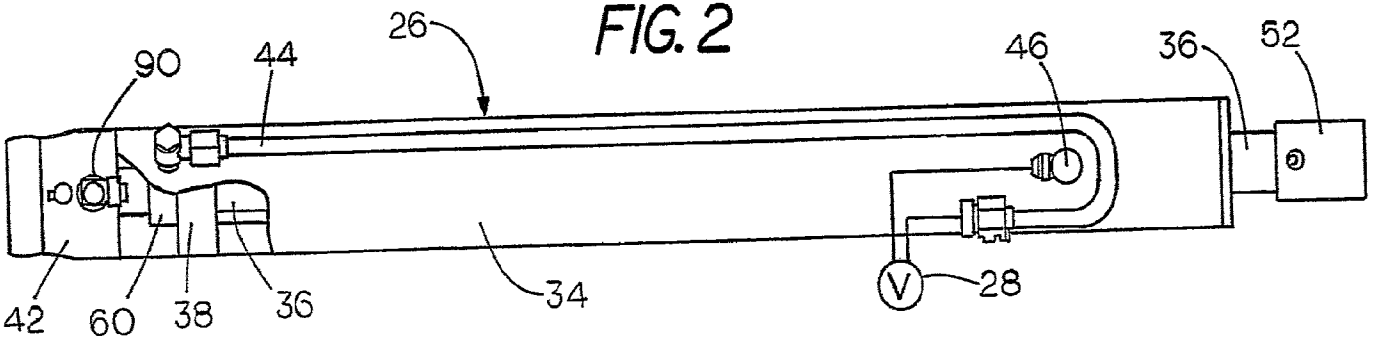
FIG. 2 is a top plan view of a hydraulic cylinder assembly shown in FIG. 1.
Figure 3:
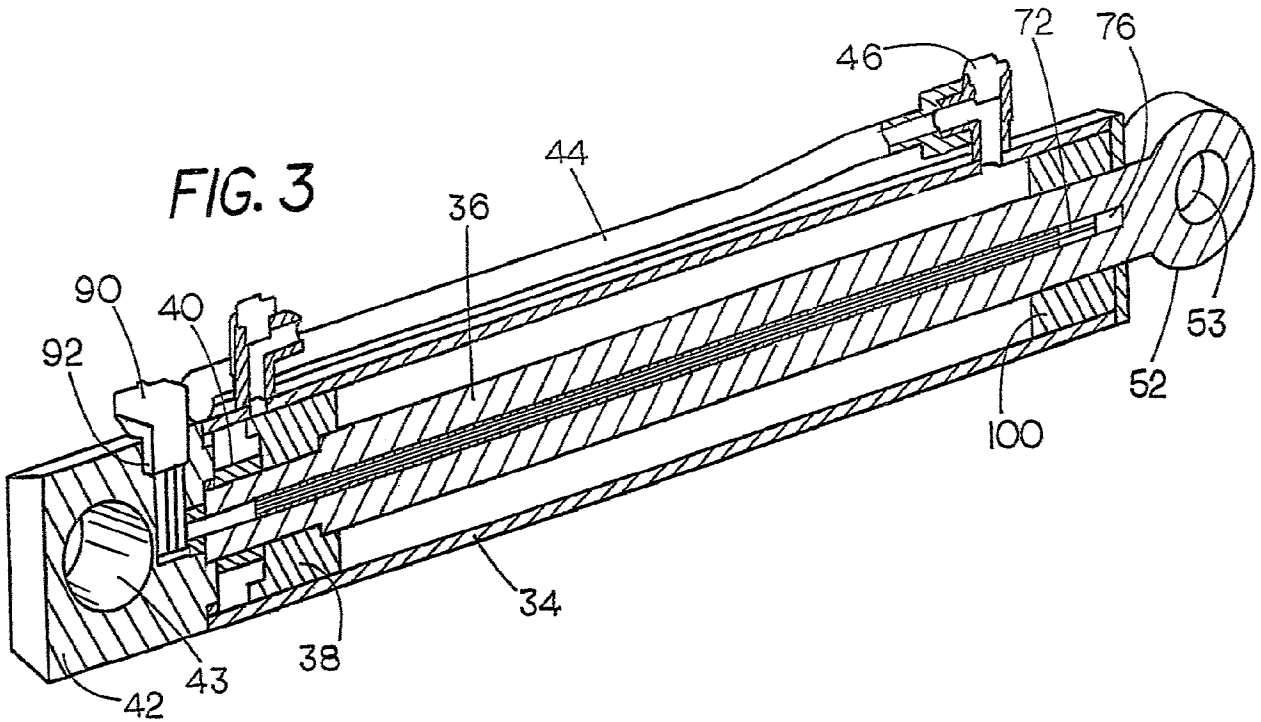
FIG. 3 is a perspective longitudinal sectional view of the cylinder assembly of FIG. 2.

The cylinder assembly 26 includes the unique sensor and connector assembly of the present disclosure, and as shown in FIG. 2, the cylinder assembly 26 has an outer circular cylinder 34 and a slidable piston 38 and piston rod 36 that are within the cylinder. The piston rod 36 as shown in FIG. 2 is attached to piston 38 with a suitable nut 40. Cylinder 34 is secured to a cylinder base 42, which has a cross bore or aperture 43 for a pin, for mounting the base onto a portion of the machine with which it is used. Additionally, a hydraulic line 44 is open to the base side of the piston 38, and a fitting 46 at the rod end is provided for providing hydraulic fluid under pressure from the valve 28 to the rod side of the piston 38.

Figure 4:
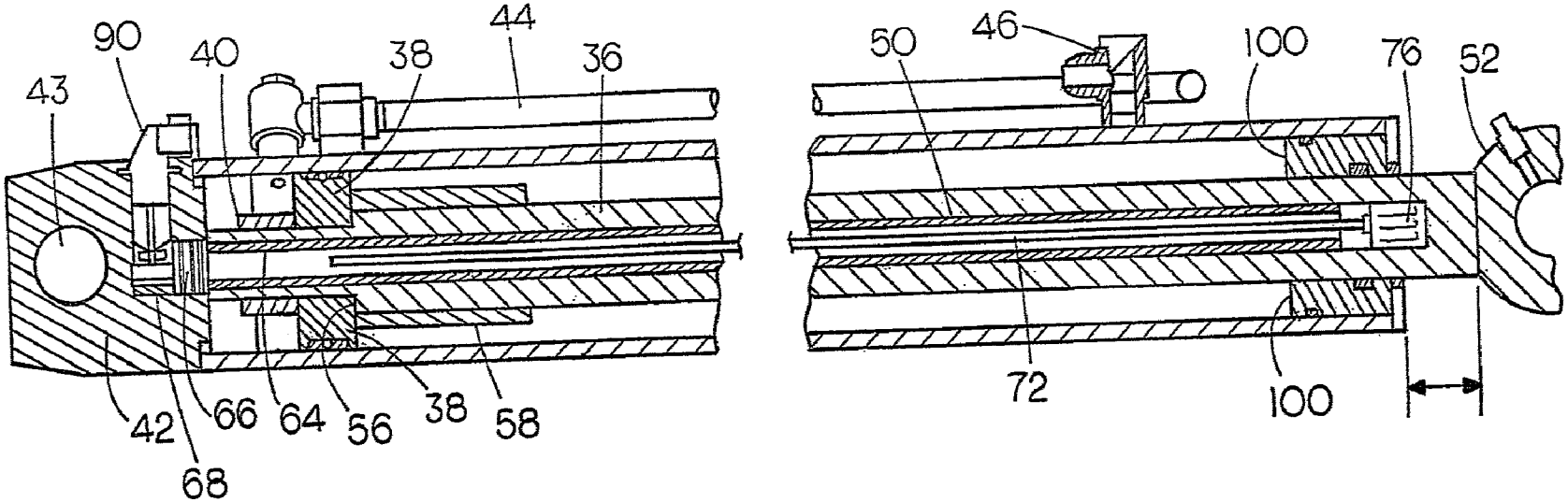
FIG. 4 is an enlarged scale sectional view of the cylinder assembly of FIG. 2.
Figure 5:
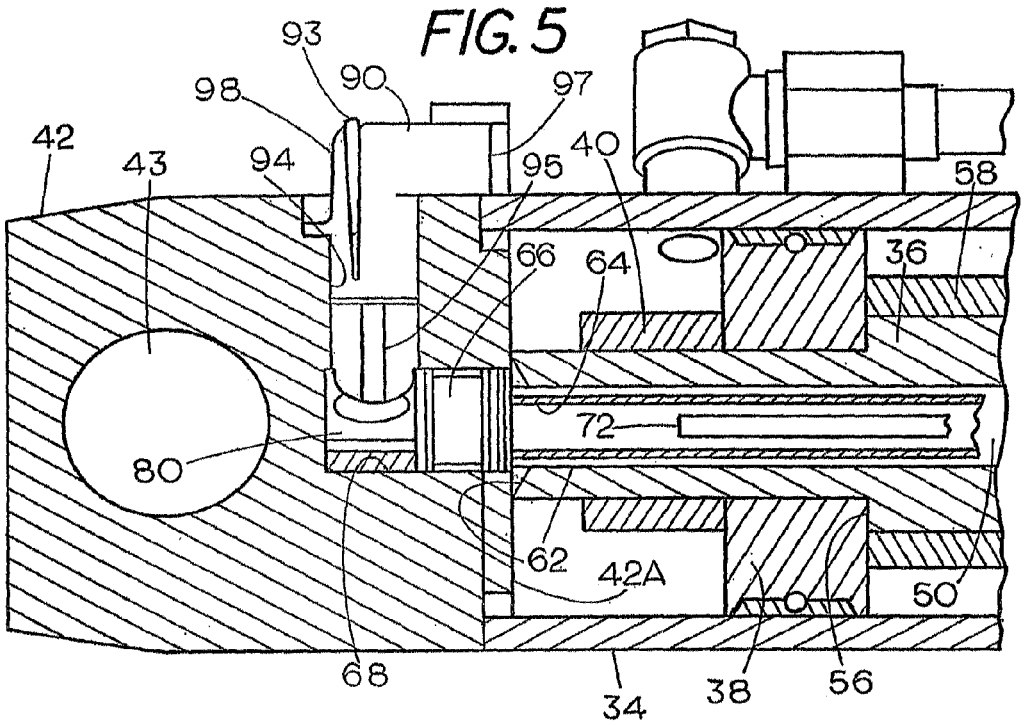
FIG. 5 is an enlarged sectional view of the base end of the cylinder assembly of FIG. 2.
Figure 6:
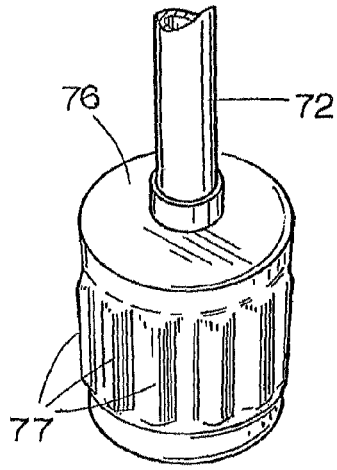
FIG. 6 is a view of a sensor core head used for supporting a sensor core rod near the remote end of the piston rod of the cylinder assembly of FIG. 2.
Figure 7:
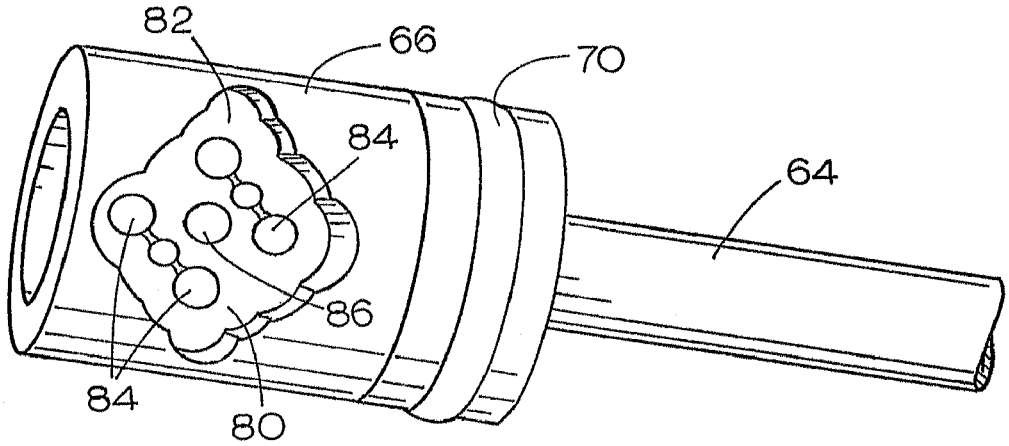
FIG. 7 is a plan view of a circuit board housing and a second portion of the tubular sleeve sensor component used with the cylinder of FIG. 2.

FIGS. 4 and 5 show that the piston rod 36 has a central bore 50 extending longitudinally along the rod, but dead ended (closed end, not a through bore) near the rod end or clevis 52 which has a pin aperture 53 for coupling the clevis to a movable member, such as a lift arm. The bore 50 can be drilled with a gun drill for accuracy, and is the same uniform diameter along its entire length, including the remote end. The piston 38 is held in place on the piston rod 36 against a shoulder 56 and a sleeve 58 with the nut 40. The piston rod 36 extends through the piston and an inner end of the piston rod extends beyond the nut 40 and stops against the end surface of the cylinder base 42 when the piston rod is retracted.

The bore 50 in piston rod 36 has an inner end guide cone or chamfer 62 at the inner end of the piston rod to aid in inserting a tubular sensor sleeve 64 into the bore 50.

The sensor sleeve 64 slidably fits inside the bore 50 and is secured to a circuit board support housing 66. The sensor sleeve 64 can be welded to the circuit board housing 66 so that it is securely fastened. The circuit board housing 66 is made to fit into a bore 68 in the cylinder base 42. The bore 68 is centered on the axis of the piston 38 and piston rod 36, and the housing 66 fits completely into bore 68 and is held in place with friction from a suitable O-ring 70, or other securing devices, that hold the sensor sleeve securely in place. The O-ring also seals the bore at its outer end so hydraulic fluid under pressure cannot enter the bore 68.

The circuitry connections for the sensor sleeve 64 are in the circuit board housing, and the circuit board housing does not require modification of the size of a standard cylinder base. The circuit board housing 66 does not interfere with the stopped position of the piston rod on the end surface 42A of the base 42, as seen in FIG. 5.

The longitudinal bore 50 in the cylinder rod dead ends near the outer end of the piston rod, and a sensor core rod 72 is mounted in the bore 50 before the sensor sleeve is installed. The core rod 72 is slidably positioned on the interior of the tubular sensor sleeve 64. The core rod 72 is secured to a head member 76 that is press-fitting into the bore 50 and retained at the outer or remote end of the bore 50 in the piston rod. The head 76 has ribs 77 that press into the end of bore 50. The ribs 77 on the head 76 form a slightly larger circle than the diameter of bore 50, but the head 76 can be moved to the remote end of the bore by tapping the free end of the core rod so the head will slide to the remote end of the bore where it will remain securely anchored in place. The head 76 supports the sensor core rod 72 securely so that the sensor core rod moves with the piston rod as the piston rod is extended or retracted. The sensor core and sensor rod are available from Penny+ Giles, having a US Office at 5875 Obispo Avenue, Long Beach Calif.

A suitable circuit board shown at 80 is supported in the circuit board housing 66 in the bore 68 in the cylinder base 42, and is aligned with and faces an opening 82 in the circuit board housing 66.

The opening 82 is generally square, as shown, but is skewed so a diagonal line across corners of the opening is parallel to the axis of the cylinder and piston rod. The opening thus looks diamond-shaped when viewed from an outer end of a cross bore 92 in the base 42. As shown, the circuit board 80 has four contacts 84 at the corners of the diamond shape, and a central contact 86. An electrical connector 90 that fits into cross bore 92 in the base is made to mate with the diamond shape opening 82. Bore 92 intersects the bore 68 in which the circuit board housing 66 fits. The connector 90 has a shank 94, with four radial ribs 95 which fit through the bore 92, and pass into the opening 82. The outer edges of the ribs are of size and are rounded to fit into the four corners of the opening 82. The ribs 95 have contacts 99 on the inner or lower ends that are arranged to mate with contacts 84 on the circuit board 80. The connector 90 also has a center contact on the inner or lower end of shank 94 that mates with contact 86 on the circuit board 80. The connector 90 will fit into opening 82 in four positions, with a square opening 90 degrees apart. Outer fitting end 97 of the connector which faces in a direction 90° from the axis of shank 94 can thus be located with the end 97 facing in four directions 90 degrees apart, to aid in making connections with wiring when there are different mountings for the base of the cylinder assembly 26.

The opening 82 may have shapes different than square, but has a plurality of distinct corners or receptacles for receiving the ribs of shank that will fit into the corners of receptacles of the opening in a plurality of positions about the axis of the cross bore. The contacts on the circuit board would be arranged to be engaged correctly by contacts on the connector in each of the plurality of positions.

Figure 8:
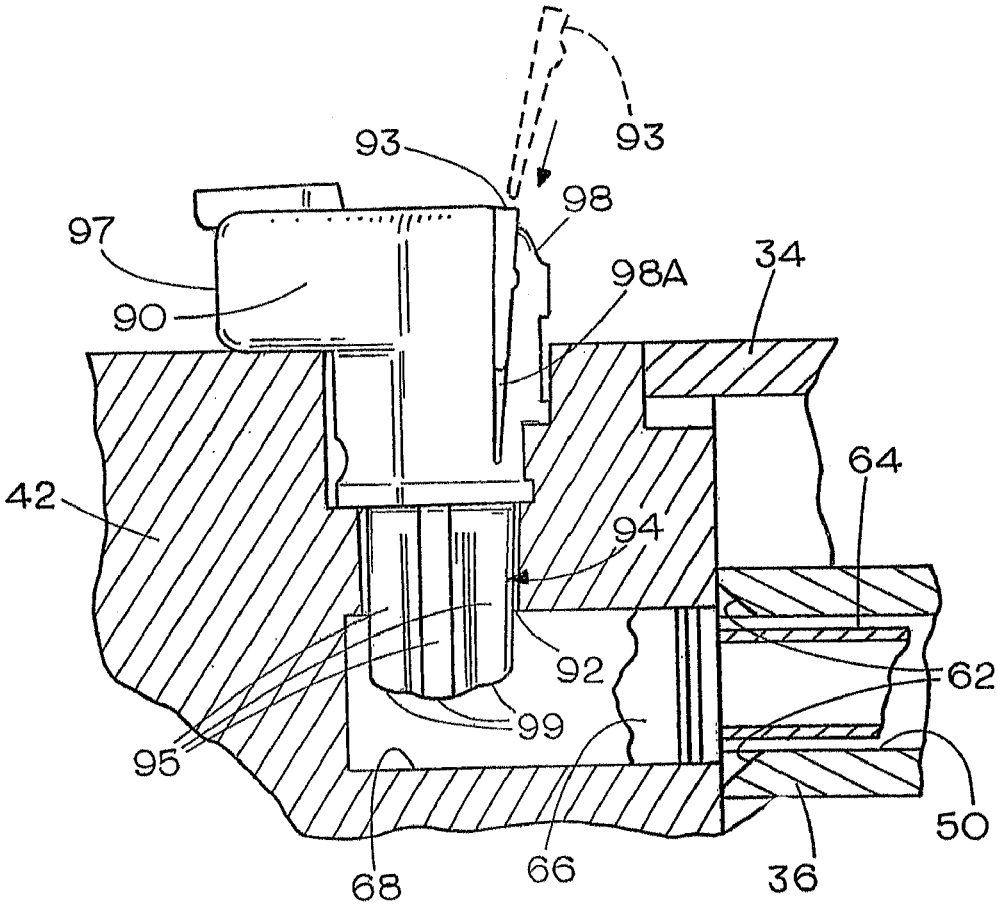
FIG. 8 is a side view of a typical connector that is connected to the circuit board in the circuit housing shown in FIG. 7.

Additionally, as can be seen in FIG. 8, the connector 90 has an integral lock dog 98 that is separated from the body of the connector to form a V shaped recess 98A. The dog 98 can be forced outwardly from the body of the connector and engage and bear against a surface of the bore 92, when a lock wedge 93 is pushed into the V shaped groove 98A to lock the connector in place. The lock wedge 93 is shown in dotted lines in FIG. 8 in position to be inserted into the groove 98A. A retainer lug on the lock wedge fits into a recess on the lock dog 98 to hold the wedge in place when it has been properly inserted into the groove 98A. The connector 90 is capable of being fastened in place in any one of the four angular or rotational positions, which can be selected so that the connector end 97 of the connector 90 is facing in an appropriate direction for connection to leads for different installation locations of the cylinder assembly. The connector end 97 receives a suitable coupler for carrying signals to the control module 32.

Leads from the connector end 97 are suitably connected to control module 32, and the control module also provides the necessary excitation power for providing a suitable potential on the sensor sleeve 64. The sensor sleeve 64 and the sensor core 78 form an inductive sensor, and as the piston 38 drives the piston rod 36 outwardly, the signal received by the control module will change with change in the relative position of the piston rod, and the signal will be a function of or proportional to the extension or position of the cylinder rod relative to a reference (usually retracted) position of the piston rod at all times during operation.

The sensor core 72 is securely held in place with the press fit of the head 76 in the bore 50 at the outer end of the piston rod.

The internal cone shaped guide 62 on the inner end of the rod aids in inserting the press fit head 76 for the sensor core and aids in guiding the sensor sleeve 64 into the bore 50, to aid in assembly. The bore 50 in the piston rod can be drilled with accuracy with a gun drill so that parts are made accurately.

The sensor sleeve 64 remains stationary with the base 42 of the cylinder assembly, and the sensor core or rod 72 moves as the piston rod is extended or retracted to provide the necessary signal indicating the amount of extension, and the position, of the piston rod end 52.

It should also be noted that the shank 94 of the connector 90 will lock the circuit board housing 66 in position in the bore 68 of the base 42 when the connector end is inserted in place through opening 82, as can be seen in FIG. 5. The O-ring 70 helps maintain the housing 66 and attached sensor sleeve centered as the sleeve projects into the bore 50 of the piston rod 36. When the circuit board housing 66 is mounted in the base of the cylinder assembly, during manufacturing assembly, the orientation of the circuit board housing can be easily maintained by aligning the opening 82 with the bore 92 for the connector 90 and the connector 90 then is put into place. The connector 90 is positioned so that the outer connector end is oriented in the proper direction for the particular installation of the cylinder. The lock wedge 93 is then inserted into the V shaped recess of the connector to hold it in place. The connector contacts 99 are held in contact with the contacts on the circuit board. The connector 90 holds the circuit board housing 66 and the sensor sleeve 64 securely. The O-ring 70 seals the bore 68 from hydraulic fluid on the base side of piston 38. Special tools are not necessary for this assembly. The sensor core rod 72 and head member 76 will be pre-assembled into the bore 50 of the piston rod by pressing in the end head member 76 into place. The taper 62 leading to bore 50 at the end of the piston rod ensures that the end of the sensor sleeve will enter into the bore 50 of the piston rod easily. An end cap 100 is placed to close the open end of the cylinder 34 so the assembly is easy and quickly done.

The cylinder assembly, including the sensor sleeve and the sensor core, when assembled into a cylinder, has the same pin to pin (through the base bore and through the rod end connector opening) dimensions as a cylinder used in the same application but with a standard base without a sensor and connector, provided that in the cylinder retracted position shown in FIG. 4, where the inner end of the rod 36 stops against the base 42, the length of the exposed rod 36 from the end cap 100 to the base of the rod end 52, indicated by the double arrow in FIG. 4 is a selected amount. The extension will compensate for different dimensions of the standard base which permits the rod to extend more. Recessing the connections in a bore in a standard size cylinder base and providing an electrical connector on the base of the cylinder without increasing the cylinder length permits the sensor equipped cylinder to be used in installations designed for non-sensor equipped cylinders. The circuit board housing does not interfere with the position where the piston rod stops against the end surface of the cylinder base Although the present invention has been described with reference to preferred embodiments, workers skilled in the art will recognize that changes may be made in form and detail without departing from the spirit and scope of the invention.

What is claimed is:

1. A fluid pressure cylinder assembly for a work machine comprising a tubular cylinder, a piston rod assembly comprising a piston rod and a piston secured to the rod, the piston being slidably mounted on an interior of said tubular cylinder, a base connected to one end of the tubular cylinder, the base having a first bore formed therein in alignment with the piston rod and a second bore, the second bore being a cross bore in communication with the first bore, a sensor comprising a sensor sleeve and a sensor core mounted in the cylinder, said sensor sleeve being secured to the base and extending into a longitudinal bore in the piston rod, the sensor core carried by the piston rod in the piston rod bore and secured to the piston rod at an end of the bore remote from the piston, said sensor core slidably fitting on an interior of said sensor sleeve, a circuit board housing sealingly mounted in the first bore, said circuit board housing having an opening on a side thereof oriented to be aligned with the second bore, and a connector extending through the second bore in the base and having an end that extends through the opening on the side of the circuit board housing, said connector having contacts on an end that enters the circuit board housing to contact terminals on the circuit board in the circuit board housing.

2. The fluid pressure cylinder assembly in claim 1, the opening on the side of the circuit board housing having a plurality of corners, wherein the connector has a shank that has complementary corners such that the shank fits into the opening on the side of the circuit board housing only in a plurality of distinct positions.

3. The fluid pressure cylinder assembly in claim 2, wherein the opening on the side of the circuit board housing has four corners, and the connector is positionable in four different rotational positions.

4. The fluid pressure cylinder assembly in claim 3, wherein the four corners form a square shape wherein a diagonal line through two of the corners lie along a plane passing through the longitudinal axis of the cylinder assembly.

5. A fluid pressure cylinder assembly comprising a tubular cylinder, a piston rod assembly comprising a piston rod and a piston secured to the rod, the piston being slidably mounted on an interior of said tubular cylinder, the piston rod having a longitudinal bore extending from an end of the piston rod adjacent the piston to a remote bore end, a base fixed to one end of the tubular cylinder, the base having a first bore formed therein in alignment with the piston rod and a second bore, the second bore being a cross bore being open from an exterior of the base and in communication with the first bore, a sensor comprising a sensor sleeve mounted in the cylinder, said sensor sleeve secured to a circuit housing sealingly secured within the first bore and extending into the longitudinal bore in the piston rod, a sensor core secured to the piston rod at the remote bore end of the longitudinal bore in the piston rod, said sensor core slidably fitting on an interior of said sensor sleeve and extending for a selected length along the sensor sleeve, electrical connections in the circuit housing connected to the sensor sleeve, and an opening in a side of the circuit housing, electrical contacts forming part of the electrical connections on an interior of the circuit housing and accessible from an exterior of said circuit housing through the opening in the side of the circuit housing, and a connector in the second bore extending through the opening in the side of the circuit housing, for engaging the electrical contacts to connect the sensor sleeve to external sensor circuitry to sense the relative positions of the sensor sleeve and sensor core.

6. The fluid pressure cylinder assembly of claim 5, wherein said circuitry in said circuit housing comprises a circuit board having the electrical contacts thereon.

7. The fluid pressure cylinder assembly of claim 6, wherein said circuit board electrical contacts are in alignment with and facing the opening in the side of the circuit housing.

8. The fluid pressure cylinder assembly of claim 5, wherein the connector in the cross bore extends through the opening in the side of the circuit housing and has electrical contacts on an end engaging the electrical contacts on the circuit board in the circuit housing.

9. The fluid pressure cylinder assembly of claim 5, wherein the longitudinal bore in said piston rod has an internal annular taper expanding outwardly from the longitudinal bore at the end thereof adjacent the piston.

10. A method of mounting a sensor for sensing position of a piston rod of a fluid pressure cylinder assembly for a work machine relative to a cylinder based wherein the fluid pressure cylinder assembly comprises a tubular cylinder, a base connected to one end of the tubular cylinder, a piston rod assembly comprising a piston rod and a piston secured to the rod, and the piston being slidably mounted on an interior of said tubular cylinder, the method comprising providing a sensor having sensor parts comprising a sensor sleeve and a sensor core slidably fitting into the sensor sleeve, extending the sensor sleeve into a longitudinal bore in the piston rod, slidably fitting the sensor core into an interior of the sensor sleeve, mounting the sensor sleeve to one of the piston rod and base and mounting the sensor sleeve to the other of the piston rod and base, sealingly mounting a circuit board housing with a circuit board positioned therein in an axial bore in the base and providing an opening on a side of the circuit board housing oriented to be aligned with a provided lateral connector bore in the base, providing electrical contact terminals on the circuit board, the terminals being in communication with the sensor part mounted to the base, extending a connector having connector contacts on an end through the connector bore in the base and through the opening on the side of the circuit board housing to engage the connector contacts with the contact terminals on the circuit board in the circuit board housing previously mounted in the axial bore.

11. The method of claim 10 comprising forming the opening on the side of the circuit board housing with a plurality of corners, and providing the connector with complementary corners, and fitting the connector into the opening on the side of the circuit board housing in one of a plurality of distinct positions defined by the corners.

12. The method of claim 11 including forming the opening with four corners in a square shape and positioning the circuit board housing in the bore with a diagonal line through two of the corners lying on a plane passing through a longitudinal axis of the cylinder.

13. The method of claim 12 including the step of providing a standard hydraulic cylinder assembly having a first pin aperture in the base for mounting the base to a support, and the rod having a rod end connector external of the tubular cylinder, a second pin aperture in the rod end connector for connecting to a member, said standard hydraulic cylinder having a pin to pin dimension between the pin apertures, and mounting the circuit board housing, the sensor sleeve and sensor core in the axial bore of the base and in the piston rod bore such that the first dimension between the first and second pin apertures with the piston in a retracted position and with the piston in an extended position is not altered by the mounting of the sensor sleeve and sensor core.

* * * * *